US005469248A

United States Patent [19]

Fujiwara et al.

[11] Patent Number: 5,469,248

[45] Date of Patent: Nov. 21, 1995

[54] IMAGE FORMING APPARATUS HAVING MEANS FOR APPLYING A COMMON TRANSFER BIAS VOLTAGE TO FIRST AND SECOND TRANSFER ROLLERS

[75] Inventors: Shigeru Fujiwara; Masashi Takahashi, both of Kanagawa; Haruhiko Ishida, Tokyo, all of Japan

[73] Assignee: Kabushiki Kaisha Toshiba, Kawasaki, Japan

[21] Appl. No.: 186,149

[22] Filed: Jan. 25, 1994

[30] Foreign Application Priority Data

Feb. 1, 1993 [JP] Japan ..... 5-014345
Dec. 15, 1993 [JP] Japan ..... 5-313905

[51] Int. Cl.[6] ..... G03G 15/01

[52] U.S. Cl. ..... 355/326 R; 355/271; 355/272; 355/274

[58] Field of Search ..... 355/271, 272, 355/273, 274, 275, 326 R, 327, 328, 277

[56] References Cited

U.S. PATENT DOCUMENTS

| | | | |
|---|---|---|---|
| 5,187,536 | 2/1993 | Hagegawa et al. | 355/327 |
| 5,300,984 | 4/1994 | Fuma et al. | 355/275 X |
| 5,314,774 | 5/1994 | Camis | 355/272 X |
| 5,337,136 | 8/1994 | Knapp et al. | 355/326 R |

FOREIGN PATENT DOCUMENTS

| | | | |
|---|---|---|---|
| 0377315 | 7/1990 | European Pat. Off. | 355/326 A |
| 0067337 | 6/1977 | Japan | 355/327 A |
| 53-93031 | 8/1978 | Japan . | |
| 0006559 | 1/1979 | Japan | 355/326 A |
| 0162571 | 9/1984 | Japan | 355/326 A |
| 2-105174 | 4/1990 | Japan . | |
| 3-287861 | 12/1991 | Japan . | |

*Primary Examiner*—Sandra L. Brase
*Attorney, Agent, or Firm*—Foley & Lardner

[57] ABSTRACT

An image forming apparatus includes a first image forming unit for forming a first image on a first image carrier, a second image forming unit for forming a second image on a second image carrier, a conveyor belt confronting the first and second image carriers for conveying an image receiving medium to the first and second image carriers successively. The apparatus further includes a first transfer roller for transferring the first image from the first image carrier to the image receiving medium, the first transfer roller being located at a first distance from a first transfer position of the first image carrier along a conveying direction of the image receiving medium, and a second transfer roller for transferring the second image from the second image carrier to the image receiving medium, the second transfer roller being located at a second distance from a second transfer position of the second image carrier shorter than the first distance along the conveying direction of the image receiving medium. A common transfer bias voltage is applied to the first and second transfer rollers to form first and second electric fields at the first and second transfer positions, respectively.

6 Claims, 9 Drawing Sheets

SEPARATION DISTANCE 12mm

SEPARATION DISTANCE 0mm

IMAGE FORMING APPARATUS HAVING MEANS FOR APPLYING A COMMON TRANSFER BIAS VOLTAGE TO FIRST AND SECOND TRANSFER ROLLERS

BACKGROUND OF THE INVENTION

1. Field of the Invention

The present invention relates to a multi-colored image forming apparatus which develops an image in multiple colors through a plurality of developing devices, transfers this image developed in multiple colors on an image receiving medium and fixes the transferred image on the image receiving medium as a permanent image and, more particularly, to a multi-colored image forming apparatus which has an improved transfer mechanism for transferring a developed image on an image receiving medium.

2. Description of the Related Art

A multi-colored image forming apparatus which has been disclosed in the Japanese Laid-open Patent Publication No. P02-105174 has been well known. That is, a method to form a developed image on a photosensitive drum and repetitively transfer a developed image in each of multiple colors on an image receiving medium has been put to practical use. Further, as an image receiving medium carrier, such laminate insulators as plastic and the like, which are capable of holding charge, were so far used and an electric field for transferring images was formed by charging this insulator by a corona charger. However, there was such a problem that ozone poisonous to the human body would be generated if the transfer electric field was formed as described above.

In order to solve this problem, as shown in the Japanese Laid-open Patent Publication No. P03-287861, an image transfer device which uses a semi-conductive sheet as an image receiving medium carrier has been considred. When such a semi- conductive sheet is used as an image receiving medium carrier like this image transfer device, a satisfactory image transfer at a low bias voltage below 2 kV becomes possible and the necessity for providing a discharging device for the image receiving medium carrier can be eliminated as the self-discharging is possible. In addition, there is such a merit as no ozone will be generated at all.

However, in case of this transfer device, the image transfer margin of a half-tone image with a small quantity of toner applied is narrower than the transfer margin of a solid image with much toner applied, that is, the range of transfer bias voltage under which an image can be transferred satisfactorily. Therefore, there was such a problem that transfer efficiency of transfer bias voltage for a half-tone image changed larger than that of a solid image and a half-tone image cannot be transferred satisfactorily under the same transfer bias voltage if electric resistance of an image receiving medium changed by change in environmental conditions such as temperature and humidity.

In particular, when multiple transfers were performed by providing a bias voltage applying part to each of the transfer portion of an image carried in a multi-colored image forming apparatus which has a plurality of image carriers, transfer efficiency of a hlaf-tone image changes remarkably with the increase of the number of transfers. This is because a size of the transfer electric field is changed in the direction of multiple transfers by the charge of an image receiving medium or the effect of developers which were already transferred on the image receiving medium if the image was transferred by applying the same bias voltage despite of a plurality of the surfaces of image carriers being charged to the equal potential. Therefore, there was such a problem that when the same transfer bias voltage was applied to a plurality of bias voltage applying parts, the color reproducibility of the colored image obtained is worse and the multi-colored image forming of good quality cannot be performed.

Because of such problems as described above, in order for stably performing a satisfactory multi-colored image transfer, it was so far necessary to provide environmental sensors to sense temperature humidity or a transfer bias power source which is capable of automatically varying output voltage. As a result, a multi-colored image forming apparatus became complicate in the structure and caused in cost increase.

Further, the Japanese Laid-open Patent Publication No. P53-93031 disclosed a multi-colored image forming apparatus which forms images developed in different colors on a plurality of photosensitive drums and sequentially transfers these colored images on a transfer paper being conveyed by a belt, thus obtaining a multi-colored image. In this multi-colored image forming apparatus, transfer rollers have been arranged by pressure fitting them closely to the back of the belt at transfer positions to pressure fit the belt to the photosenstitive drums, and voltage of polarity reverse to the developers are applied to these transfer rollers. Voltage to be applied to the transfer rollers are made higher gradually in the transfer sequence. That is, when transferring the images developed in different color developers sequentially, transfer efficiency is increased by applying higher voltage to the second color than the first color, to the third color higher than the second color and so on. In this embodiment of the Publicaiton, bias voltage of 2.5 kV, 3.0 kV and 3.5 kV are applied independently to the transfer rollers for the first, second and third colors, respectively.

However, as higher bias voltages are applied independently to respective transfer rollers sequentially, a plurality of power sources become necessary. As a result, there is such a problem that a power supply occupies a large space in the multi-colored image forming apparatus and the apparatus would become expensive.

SUMMARY OF THE INVENTION

It is an object of the present invention to provide a multi-colored image forming apparatus capable of transferring a multi-colored image, which is first formed in multiple colors on a plurality of image carriers and then transferred sequentially on an image receiving medium multiply, always stably at high transfer efficiency regardless of environmental changes.

According to the present invention there is provided an image forming apparatus comprising first image forming means for forming a first image on a first image carrier; second image forming means for forming a second image on a second image carrier; conveying means confronting the first and second image carriers for conveying an image receiving medium to the first and second image carriers successively; first transferring means for transferring the first image from the first image carrier to the image receiving medium, the first transferring means being located at a first distance from a first transfer position of the first image carrier along a conveying direction of the image receiving medium; second transferring means for transferring the second image from the second image carrier to the image receiving medium, the second transferring means being located at a second distance from a second transfer position of the second image carrier shorter than the first distance along the conveying direction of the image receiving medium; and applying means for applying a common transfer bias voltage to the first and second transferring means to form first and second electric fields at the first and second transfer positions, respectively.

BRIEF DESCRIPTION ON THE DRAWING

The above and other objects, features and advantages of the present invention will become more apparent from the following detailed description when taken with the accompanying drawing in which.

DETAILED DESCRIPTION OF THE PREFERRED EMBODIMENTS

A first embodiment of the present invention will be described hereinafter with reference to the drawings.

Figure 1:
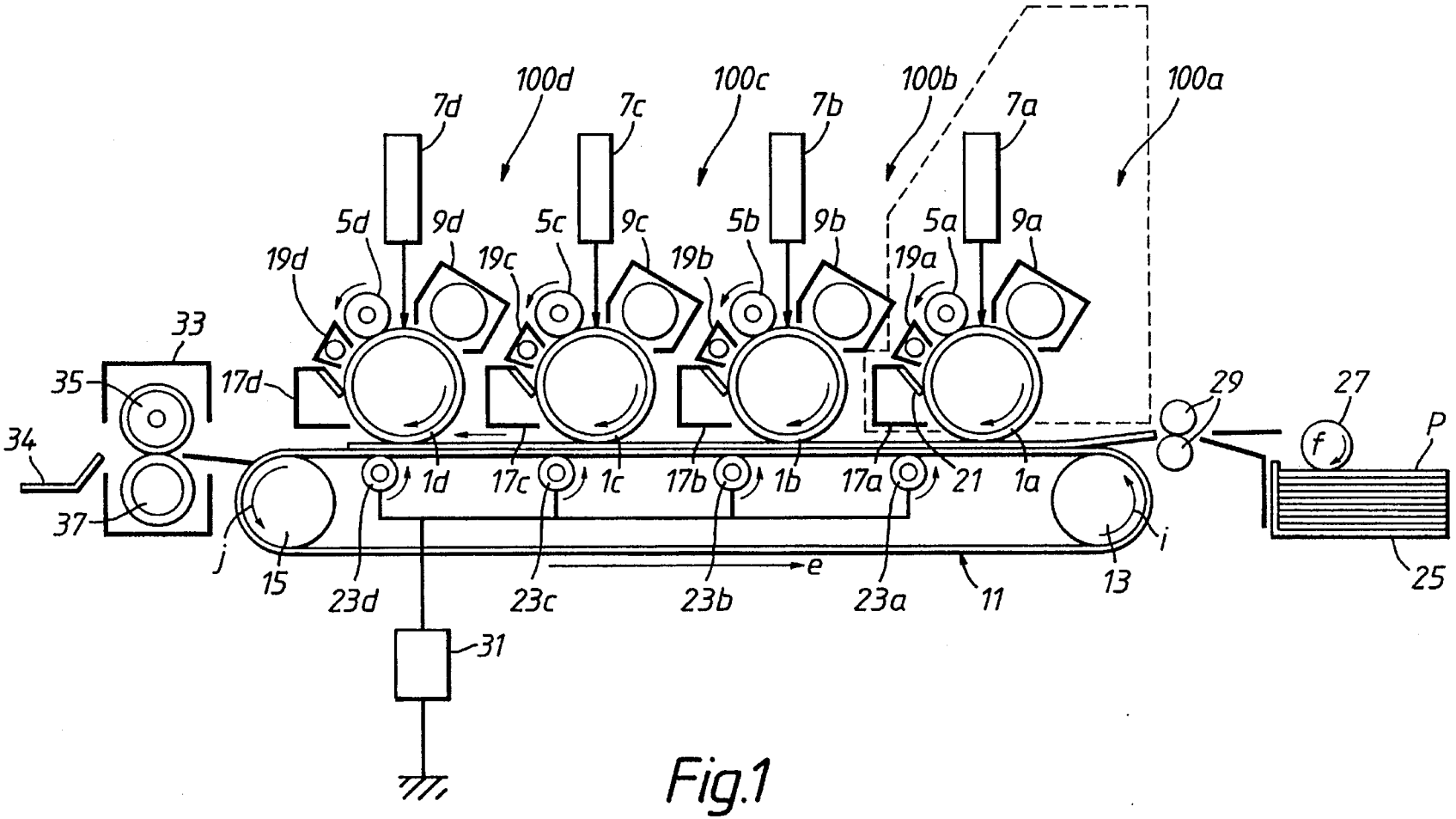
FIG. 1 is a schematic diagram showing a first embodiment of a multi-colored image forming apparatus of the present invention.

FIG. 1 is a schematic diagram showing the first embodiment of the multi-colored image forming apparatus of the present invention. In FIG. 1, a photosensitive drum 1*a*, which is an image carrier, is a cylindrical drum 40 mm in diameter and is provided rotatable in the arrow direction as illustrated.

Around this photosensitive drum 1*a*, the following items have been arranged along its rotating direction. A charging roller 5*a*, which charges the photosensitive drum 1*a* uniformly, is provided in contact with the surface of the photosensitive drum 1*a*. At the downstream side of this charging roller 5*a*, an exposure portion 7*a* is provided for forming an electrostatis latent image by exposing it on the charged photosensitive drum 1*a*. Further, at the downstream side of the exposure portion 7*a*, a developing device 9*a* is provided, which contains a black developer and develops the electrostatic latent image formed by the exposure portion 7*a* using this black developer. At the downstream of the developing device 9*a*, a conveyor belt 11 is provided, which conveys paper P, which is an image receiving medium, to the photosensitive drum 1*a*.

Further, at the downstream side from the position where the photosensitive drum 1*a* is in contact with the paper P, a cleaning device 17*a* and a discharge lamp 19*a* are provided. The cleaning device 17*a* is to remove the developer left on the photosensitive drum 1*a* by scraping it with a blade 12 after the developer image was transferred on the paper P. The discharge lamp 19*a* is to discharge the surface of the photosensitive drum 1*a* after transferring the image. When the photosensitive drum 1*a* is discharged by this discharge lamp 19*a*, one cycle of the image forming process is completed and the uncharged photosensitive drum 1*a* will be charged again by a charging roller 5*a* in the next image forming cycle.

The convenyor belt 11 is in the nearly same width as the length of the photosensitive drum 1*a* in the direction of the rotary shaft. This conveyor belt 11 is of endless type with support rollers 13 and 15 provided at the annular portions of its upstream and downstream sides., respectively. The conveyor belt 11 is kept in contact with the support rollers 13 and 15 along with the outer circumferences of the support rollers 13 and 15 at the annular portions. A distance from the support roller 13 to the support roller 15 is approx. 300 mm. The support rollers 13 and 15 are provided rotatably in the arrow directions 1 and j as shown in FIG. 1. With the rotation of the support rollers 13 and 15, the conveyor belt 11 is moved in the direction e.

A paper supply cassette 25 which contains the paper P is provided neap this conveyor belt 11. This paper supply cassette 25 is provided with a pick-up roller 27 rotatably in the arrow direction f for picking up the paper P one sheet at a time. A register roller pair 29 composing of the upper and lower Pollers is provided at this side of the conveyor belt 11 rotatably state in the direction of conveying the paper P picked up by the pick-up roller 27. The register roller pair 29 sends out the paper P being conveyed to the conveyor belt 11 at such a timing that the leading edge of a developed image formed on the photosensitive drum la comes to the leading edge of the paper P.

A process unit 100*a* is composed of the photosensitive drum 1*a*, the charging roller 5*a*, the exposure portion 7*a*, the developing device 9*a*, the cleaning device 17*a* and the discharge lamp 19*a* described above.

On the conveyor belt 11, process units 100*b*, 100*c* and 100*d* are provided in addition to the process unit 100*a* along the conveying direction between the support rollers 13 and 15 (hereinafter, the process units 100*a*, 100*b*, 100*c* and 100*d* are named generically as a process unit 100). All of the process units 100*b*, 100*c* and 100*d* are in the same construction as that of the process unit 100*a*. That is, photosensitive drums 1*b*, 1*c* and 1*d* (hereinafter, the photosensitive drums 1*a*, 1*b*, 1*c* and 1*d* are named generically as a photosensitive drum 1) are provided at the almost center of respective process units. Around this photosensitive drum 1, charging rollers 5*b*, 5*c* and 5*e* are provided (hereinafter, the charging rollers 5*a*, 5*b*, 5*c* and 5*d* are named generically as a charging roller 5). At the downstream of the charging roller 5, exposure portions 7*b*, 7*c* and 7*d* (hereinafter, the exposure portions 7*a*, 7*b*, 7*c* and 7*d* are named generically as an exposure portion 7) are provided. At the downstream of the exposure portion 7, developing devices 9*b*, 9*c* and 9*d* (hereinafter, the developing devices 9*a*, 9*b*, 9*c* and 9*d* are named generically as a developing device 9), cleaning devices 17*b*, 17*c* and 17*d* (hereinafter, the cleaning devices 17*a*, 17*b*, 17*c* and 17*d* are named generically as a cleaning device 17), discharge lamps 19*b*, 19*c* and 19*d* (hereinafter, the discharge lamps 19*a*, 19*b*, 19*c* and 19*d* are named generically as a discharge lamp 19) are provided. This construction is the same as that of the process unit 100*a*. Only exception is developers contained in the developing devices, that is, yellow, magenta and cyanic color developers are contained in the process units 100*b*, 100*c* and 100*d*, respectively.

The paper P conveyed by the conveyor belt 11 is brought in contact with respective photosensitive drum 1*a* through 1*d* successively. In the vicinity of the location where the paper P is brought in contact with each photosensitive drum 1, voltage supply rollers 23*a*, 23*b*, 23*c* and 23*d* are provided as means for image transfer corresponding to respective photosensitive drums 1*a* through 1*d* (hereinafter, the voltage supply rollers 23*a*, 23*b*, 23*c* and 23*d* are named generically as a voltage supply roller 23). That is, the voltage supply rollers 23*a* to 23*d* are provided to correspond to respective process units 100*a* to 100*d* through the convenyor belt 11 while their backs are brought in contact with the conveyor belt 11 in the vicinity of the location where respective photosensitive drums 1*a* to 1*d* are brought in contact with the conveyor belt 11. The voltage supply rollers 23*a* through 23*d* are rotated in the arrow direction following the movement of the conveyor belt 11. Further, the voltage supply rollers 23*a*, 23*b*, 23*c* and 23*d* are electrically connected in parallel to the same bias voltage source 31 which is a bias voltage applying means.

Here, the image forming process by the multi-colored image forming apparatus constructed as described above will be explained. First, the photosensitive drum la through 1*d* of four process units are charged uniformly to approx. −500 V by the charging roller 5.

The photosensitive drum 1 uniformly charged by the charging rollers 5 is applied with, for instance, a laser beam from the exposure portion 7 and an electrostatic latent image is formed on the photosensitive drum 1. This electrostatic latent image is developed by developers in different colors which have been pre-charged to about −20 μc/g by the developing device 9.

On the other hand, the paper P is picked up from the paper supply cassette 25 by the pick-up roller 27 and sent to the register roller pair 29. The register roller pair 29 sends out the paper P on the conveyor belt 11 while keeping in time with the rotation of the photosensitive drum 1 so that the leading edge of the developed image comes to the leading edge of the paper P.

When the paper P is conveyed, approx. 2,000 V is applied to the conveyor belt from the voltage supply roller 23 as the identical bias voltage. When this bias voltage is applied, a transfer electric field is formed between the photosensitive drum 1 and the conveyor belt 11. Therefore, an image developed in one color on the photosensitive drum 1*a* is first transferred on the paper P and the paper P carrying this developed image is conveyed to the photosensitive drum 1*b*. This developed image formed on the photosensitive drum 1*b* is transferred and superposed over the image developed in another color and previously transferred. The paper P is further conveyed to the photosensitive drums 1*c* and 1*d*, where the images developed in different colors are transferred on the paper P similarly.

The paper P carrying an image formed through the multiple transfers is sent from the conveyor belt 11 to a fixer 33. The fixer 33 has a heat roller 35 and a pressure roller 37. The paper P is passed between the heat roller 35 and the pressure roller 37 while keeping the image in contact with the heat roller, and heated and pressurized. As a result, the developed image is fixed on the paper P. Thereafter, the paper P is ejected on a receiving tray 34.

The conveyor belt 11 is made by 140 μm thick polycarbonate with carbon uniformly dispersed. Its resistance in the direction of thickness per $cm^2$ is $10^{10}$ $\Omega.cm^2$. In this embodiment the resistance of the conveyor belt 11 represents a resistance in the direction of thickness per $cm^2$ to take no thought of the thickness of belt.

In the multi-colored image forming apparatus which forms the transfer electric field by applying bias voltage to the conveyor belt 11, resistance of the conveyor belt 11 gives an important effect on the image transfer. If resistance per $cm^2$ in the direction of thickness drops to lower than $10^6$ $\Omega.cm^2$ or below, charge is given to the paper P from the conveyor belt 11. Further, this charge is given to developers and their charged polarity is reversed, lowering Transfer efficiency and it is therefore not desireable. Further, if resistance per $cm^2$ in the direction of thickness increased to higher than $10^{10}$ $\Omega.cm^2$, higher transfer bias voltage is needed to get a sufficient transfer electric field. Further, when the paper P is separated from the photosensitive drum 1 after the transfer, separation discharge is caused and the charged polarity of developers is reversed, lowering transfer efficiency and therefore, higher resistance in the direction of thickness is also not desirable. That is, developers may adhere to the photosensitive drum 1 inversely.

On the other hand, the voltage supply roller 23*a* is kept in contact with the conveyor belt 11 at the location a little away to the downstream side in the conveying direction from the location where the paper P contacts the photosensitive drum 1*a* that is a transfer position of the photosensitive drum 1*a*. Further, in this first embodiment the distance between the photosensitive drum 1*a* and the voltage supply roller 23*a* was set at 12 mm. Similarly, the voltage supply rollers 23*b*, 23*c* and 23*d* are separated from the transfer positions of respective photosensitive drums and the conveyor belt 11 to the downstream side in the conveying direction. This distances were set at 10 mm, 8 mm and 6 mm for the voltage supply roller 23*b*, 23*c* and 23*d*, respectively. That is, the distances between the photosensitive drum 1 and corresponding voltage supply rollers have been set shorter and shorter in the multiple transferring direction. Further, this separation distance is a distance from the center of a contacting nipple between each of respective photosensitive drums 1*a* through 1*d* and the paper P to the contacting location of the conveyor belt and respective voltage supply rollers.

Figure 2:
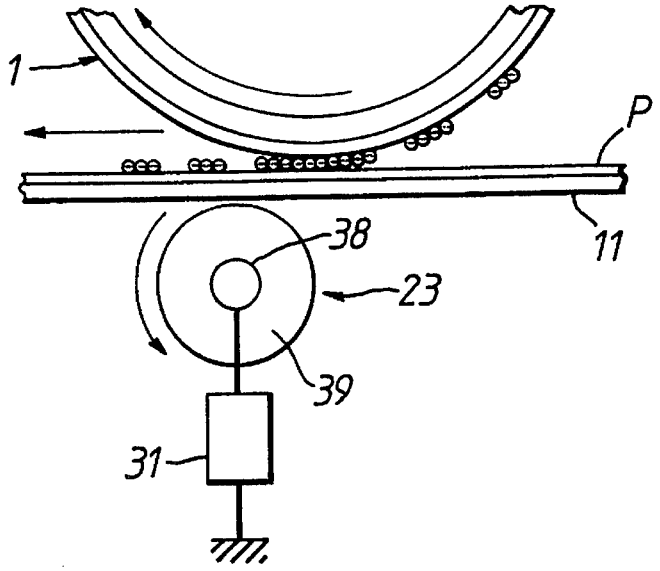
FIG. 2 is a schematic diagram showing a transfer portion including the power supply rollers of the multi-colored image forming apparatus shown in FIG. 1.

The voltage supply roller 23 is provided with an elastic layer 39 made of conductive polyurethane foam around a metallic shaft 38 as shown in FIG. 2, and resistance between the shaft 38 and the surface of the elastic layer 39 is approx.

$10^4$ Ω. The bias voltage 31 is connected to the shaft 38. The voltage supply roller 23 has proper elasticity and rotates in the arrow direction while contacting the photosensitive drum 1 from the back of the conveyor belt 11 so that an image developed on the photosensitivity drum 1 is brought in contact with the paper P under a proper pressure.

The image forming was conducted using the multi-colored image forming apparatus described above under the normal temperature and humidity. The range of proper transfer bias voltages for a solid image and a half-tone image used in this image forming is shown in FIG. 3.

Figure 3:
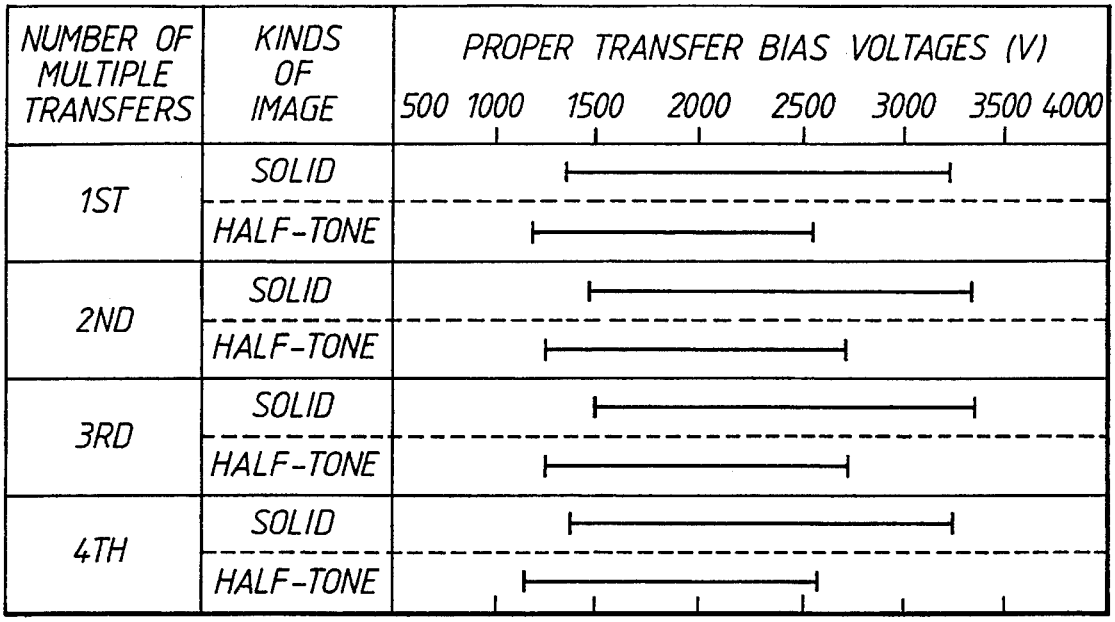
FIG. 3 is a graph showing proper transfer bias voltages in the first embodiment of the multi-colored image forming apparatus of the present invention.

In FIG. 3, the axis of abscissa shows proper transfer bias voltages and the axis of ordinates shows the number of multiple transfers and kinds of images. As to whether transfer was satisfactory, it was juded to be satisfactory if an image after fixed has a prescribed image density without causing any transfer void and rough transfer.

Figure 4:
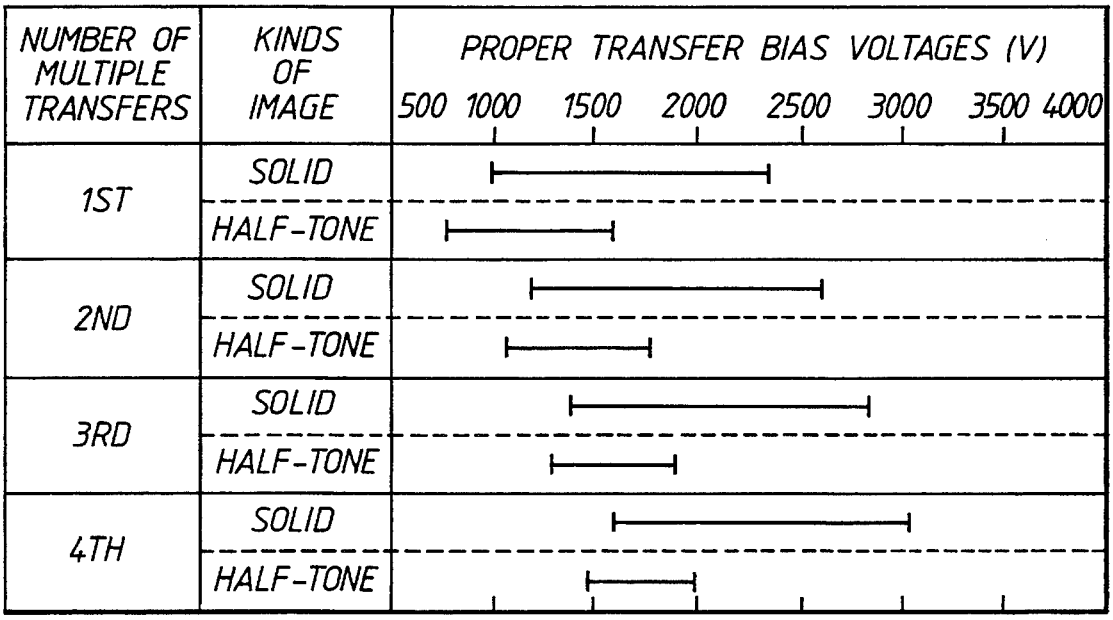
FIG. 4 is a graph showing proper transfer bias voltages in a multi-colored image forming apparatus to which the present invention was not applied, for the purpose of comparison with the graph shown in FIG. 3.

For the comparison purpose, a graph showing proper transfer bias voltages when all of the voltage supply roller 23 were provided at a location where the photosensitive drum 1 was brought in contact with the conveyor belt 11 is shown in FIG. 4.

In FIG. 4, in the case of a solid image, the proper transfer bias voltage range was wide and proper transfer bias voltage shifted to a higher level with the increase in the number of multiple transfers. On the contrary, in the case of a half-tone image, the proper transfer bias voltage range was narrow and with the increase in the number of multiple transfers, the proper transfer bias voltage range was further narrowed sequentially.

On the other hand, when the voltage supply roller 23 was provided apart from the location where the paper P contacts the photosensitive drum 1 as shown in FIG. 3, the proper transfer bias voltage will shift slightly to a higher level on the whole with the increase in the number of transfers but the proper bias voltage range in each transfer will become wide. So, it can be seen that a sufficiently stable transfer can be carried out under the same transfer bias voltage in all four transfers. Further, the supplied transfer bias voltage in this first embodiment was +2,000 V.

The result shown in FIG. 4 indicates that if the voltage supply roller 23 is brought in contact with the photosensitive drum 1 at a location where the photosensitive drum contacts the paper P, agreement of the transfer characteristic of a solid image with that of a half-tone image becomes worse with the increase in the number of transfers and a satisfactory image transfer cannot be carried out under the same transfer bias voltage in four multiple transfers.

Proper transfer bias voltage shifted to a higher level with the increase in the number of transfers in the multiple transfers is considered due to the increase in volume of developers on the paper P in proportional to the increase in the number of transfers and the weak aerial discharge taken place between the surface of the photosensitive drums and the paper P when transferring an image, charging the surface of the paper P, on which developers are transferred to the polarity reverse to transfer bias voltage and weakening the transfer electric field.

Further, a narrow range of proper transfer bias voltage for a half-tone image when the voltage supply roller's are provided at a location where the paper P is brought in contact with the photosensitive drum 1 is considered due to a large change in the transfer electric field.

On the contrary, reasons for why the proper transfer bias voltage range in each image transfer is expanded and multiple transfers can be executed under the same transfer bias voltage when the voltage supply roller 23 is provided apart from the location where the photosensitive drum 1 contacts the paper P are as shown below.

First, as the voltage supply roller 23 has been provided apart from the location where the photosensitive drum 1 contacts the paper P, the distance of the conveyor belt 11 which acts as a resistor for current control has been extended. As a result, a change in the transfer electric field is caused by environmental change, etc. and is affecting a developed image will become gentle and the range of proper transfer bias voltage for a half-tone image will be expanded.

In addition, the voltage supply rollers have been provided at the downstream side in the direction of multiple image transfers so that they get gradually nearer the location where the corresponding photosensitive drums are brought in contact with the paper P. By setting the locations of the voltage supply rollers as described above, the transfer electric field is made relatively large at the downstream of the conveyor belt 11 and thus, proper transfer bias voltage is suppressed to shift to a higher level with the increase in the number of transfers.

Using the multicolored image forming apparatus shown in FIG. 1, the image formation was conducted by changing temperature and humidity. Change in the proper transfer bias voltage range in every transfer was less and a sufficiently stable image transfer could be made in four times of the transfers under the same transfer bias voltage.

For the laminate conveyor belt 11 which was adjusted to a proper resistance in the first embodiment, such high resisting conductive sheets as ethylene terephthal, polyimide, polytetrafluoroethylene (Teflon), etc. with conductive particles such as carbon, etc. dispersed may be used in addition to the polycarbonate with carbon dispersed. A high molecular film of which resistance has been adjusted by adjusting its composition without using conductive particles is also usable. Further, such a high molecular film as this with ion conductive materials mixed or rubber materials such as silicon rubber, urethane rubber having relatively low resistance also may be used.

Figure 5:
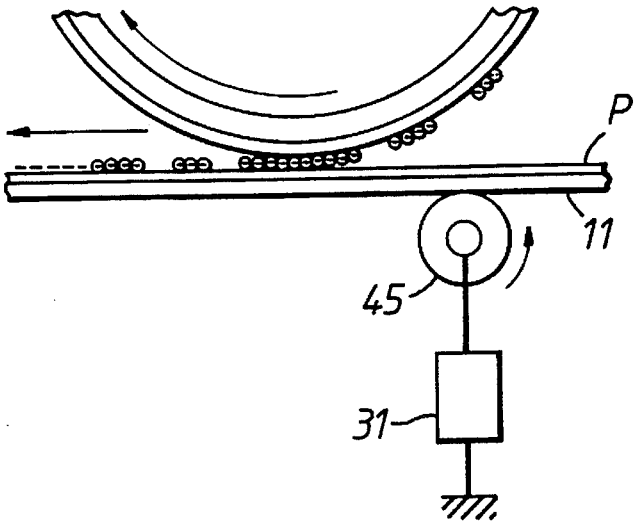
FIG. 5 is a schematic diagram showing a modified example of the installed locations of the voltage supply rollers included in the transfer portion.

The location where respective voltage supply rollers are brought in contact with the conveyor belt 11 may be provided at the downstream side from the location where the photosensitive drum is kept contacted with the paper P as in this embodiment or they may be provided at its upstream side as shown in FIG. 5. In FIG. 5, a voltage supply roller 45 was provided at the upstream from the location where the paper P was in contact with the photosensitive drum. However, when the voltage supply roller 45 is located at the upstream, the developer may be scattered on the image receiving medium by affecting of the electrical transfer field before the image receiving medium contacts with the photosensitive drum.

Further, a distance from the contacting location of the photosensitive drum 1 with the paper P to the voltage supply roller 23 is largely governed by resistance of the conveyor belt 11. However, when the same transfer bias voltage is to be applied to the voltage supply roller 23, a separation distance from the photosensitive drum 1 to a corresponding voltage supply roller at the downstream side of the conveyor belt 11 should be adjusted to be shorter so that a large electric field is obtained at the downstream side.

As a voltage supply means, any item is usable if it has lower resistance than the conveyor belt 11 and is capable of compressing the paper P against the photosensitive drum softly and uniformly.

Figure 6:
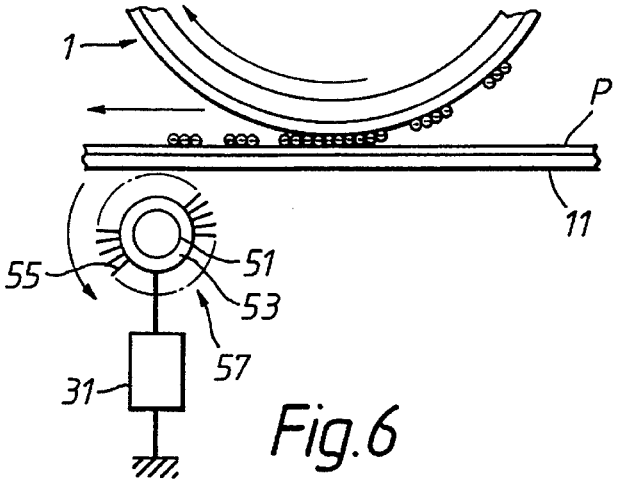
FIG. 6 is a schematic diagram showing a modified example of the voltage supply rollers.
Figure 7:
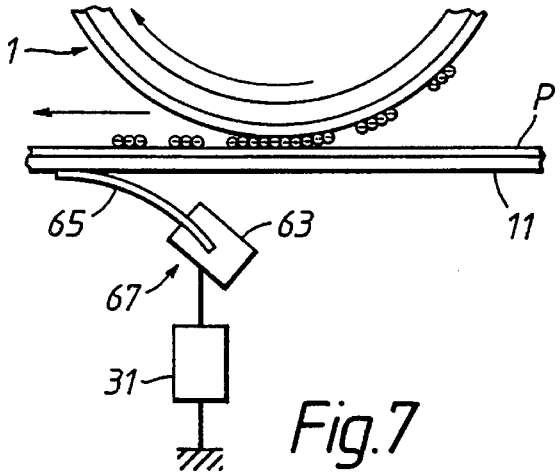
FIG. 7 is a schematic diagram showing another modified example of the voltage supply rollers.
Figure 8:
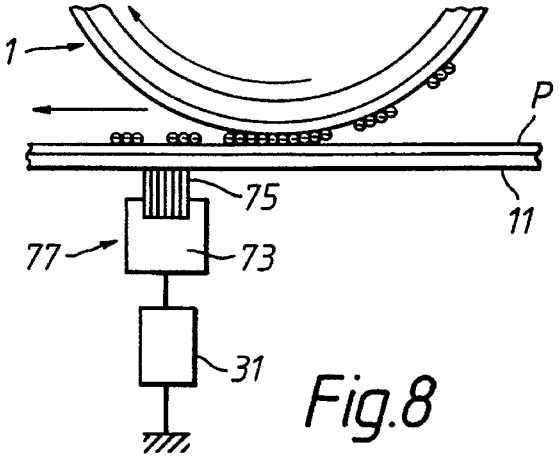
FIG. 8 is a schematic diagram further showing another modified example of the voltage supply rollers.

That is, in addition to the roller type voltage supply means described above, for instance, a rotational brush 57 with a fixed layer 53, which has a conductive brush 55 composing of rayon strings containing carbon, provided on the surface of a shaft 51 may be used as shown in FIG. 6. As shown in FIG. 7, a blade 67 composing of a conductive rubber type elastic plate 65 which is fixed to a holder 63 may be used. Furthermore, a fixed brush 77 composing of a conductive brush 75 fixed to a holder 73 shown in FIG. 8 can be used.

Figure 9:
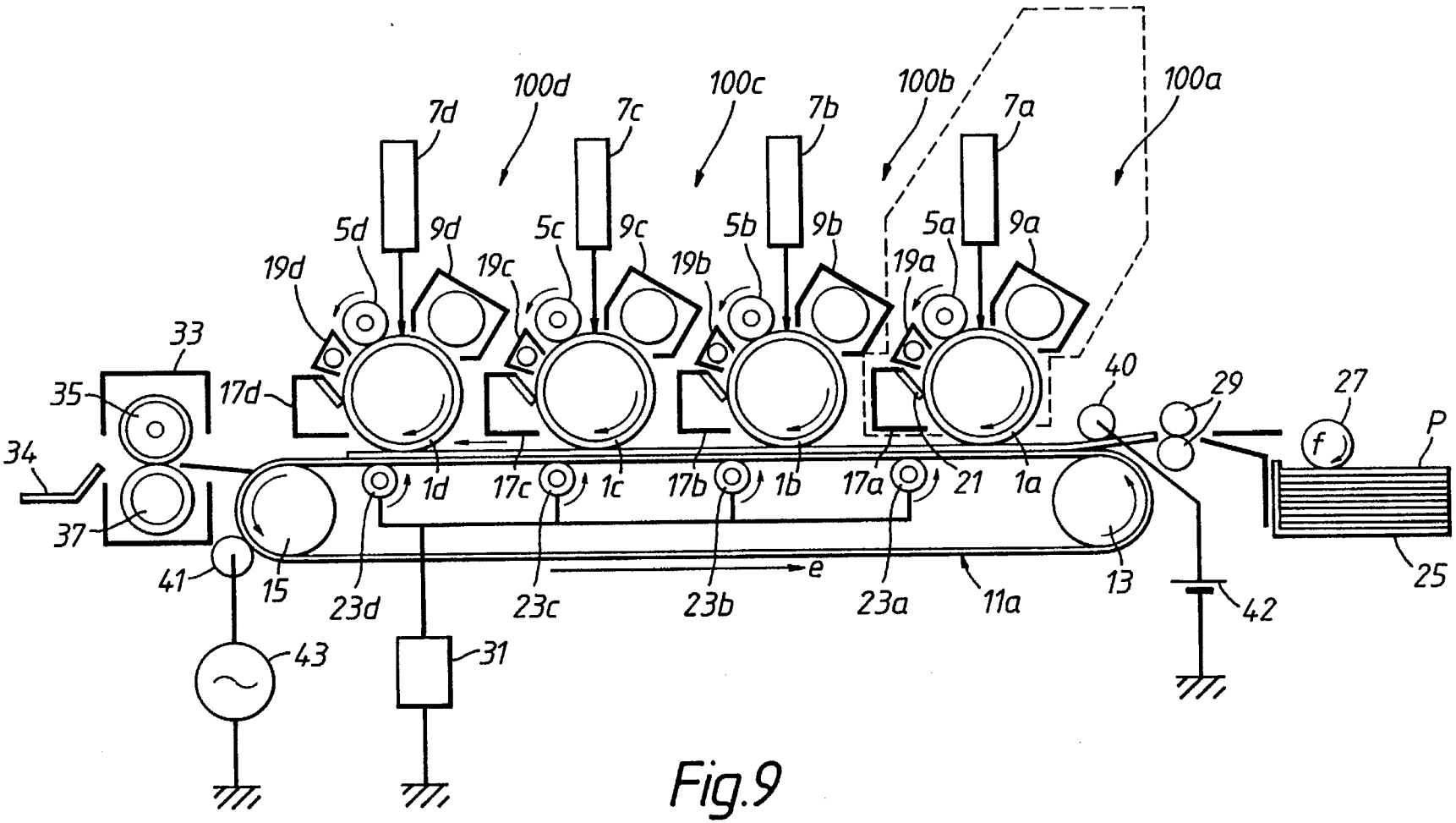
FIG. 9 is a schematic diagram showing a second embodiment of the multi-colored image forming apparatus of the present invention.

A second embodiment of the multi-colored image forming apparatus of the present invention will be described with reference to FIG. 9. Like wise the first embodiment, the conveyor belt 11*a* is made of polycarbonate resin with conductive carbon dispersed and has resistance of $10^8$ $\Omega.cm^2$ per $cm^2$ in the direction of thickness. This conveyor belt 11*a* is of endless type in 140 μm thick, 260 mm wide and 660 mm circumferential length. The photosensitive drum 1 is 40 mm in diameter and its photosensitive material is an organic photosensitive body. Four units of this photosensitive drum are arranged horizontally and the conveyor belt 11*a* is kept in contact with these photosensitive drums under a uniform compression force. The conveyor belt 11*a* is supported and driven by the support roller 15, as a driving roller composing of a conductive rubber, and the support roller 13, as a tension roller. Transfer voltage is applied and the conveyor belt 11*a* is compressed against the photosensitive drum 1 by voltage supply roller 23 composing of a conductive urethane foam rubber 12 mm in diameter. The conveyor belt 11*a* is driven and moved circularly in the direction of arrow e by the support roller 15. Moving speed of the conveyor belt 11*a* is 50 mm/sec. A stainless steel made charging roller 40, which is 8 mm in diameter, for electrostatic adsorbing the paper P to the conveyor belt 11*a* is arranged at a position to contact the conveyor belt 11*a* and opposite to the support roller 13. Further, a stainless steel made discharging roller 41, which is 10 mm in diameter, for discharging the conveyor belt 11*a* is arranged at a position to contact the conveyor belt 11*a* and opposite to the support roller 15. A DC power source to apply DC −2 kV is connected to the charging roller 40 and a AC power source 43 to apply 3 kVpp and 2 kHz AC voltage is connected to the discharging roller 41. The charging roller 40 and the discharging roller 41 are not limited to stainless steel made rollers but rollers made of conductive rubber such as urethane, silicon rubber, etc. may be used. Further, they may be in brush or blade shape.

The separation distance between the voltage supply roller 23*a* for applying the first color transfer voltage and the photosensitive drum 1*a* was set at 12 mm. This distance is the maximum distance for the convenyor belt 11*a* to maintain a force to keep the paper P compressed against the photosensitive drum 1*a* without being deflected. If the separation distance is in excess of this distance, a space between the photosensitive drum 1*a* and the paper P becomes large due to deflection of the conveyor belt 11*a*, causing a poor transfer and lowering transfer efficiency. The optimum transfer margin, when the separation distance between the voltage supply rollers and the photosensitive drums are respectively set at 12 mm, is as shown in FIG. 10.

Figure 10:
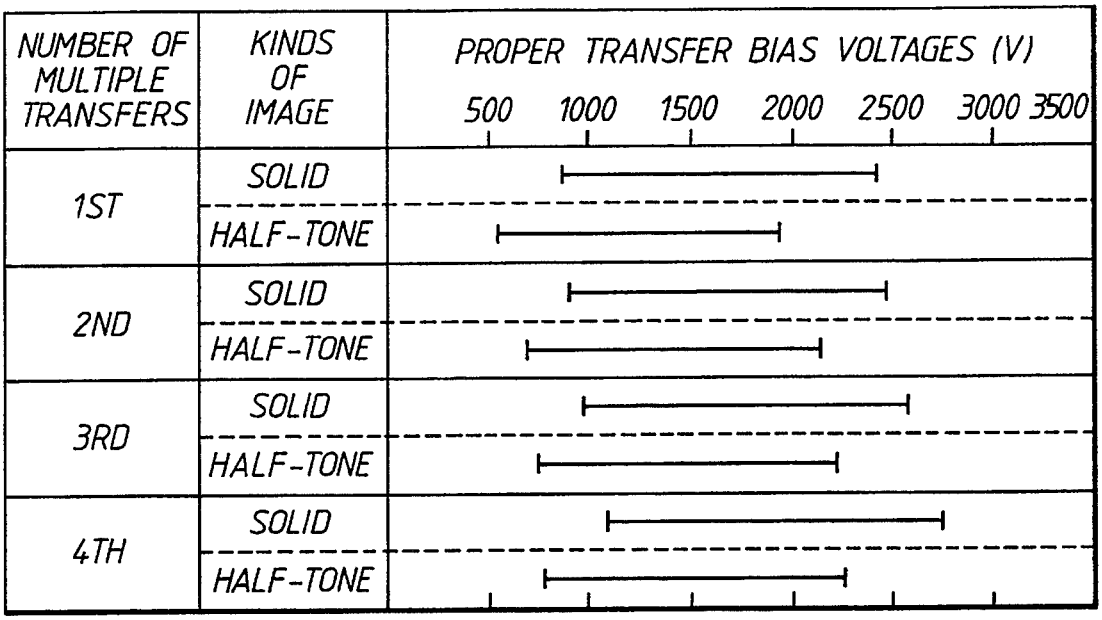
FIG. 10 is a graph showing proper transfer bias voltages in the second embodiment of the multi-colored image forming apparatus of the present invention.
Figure 11:
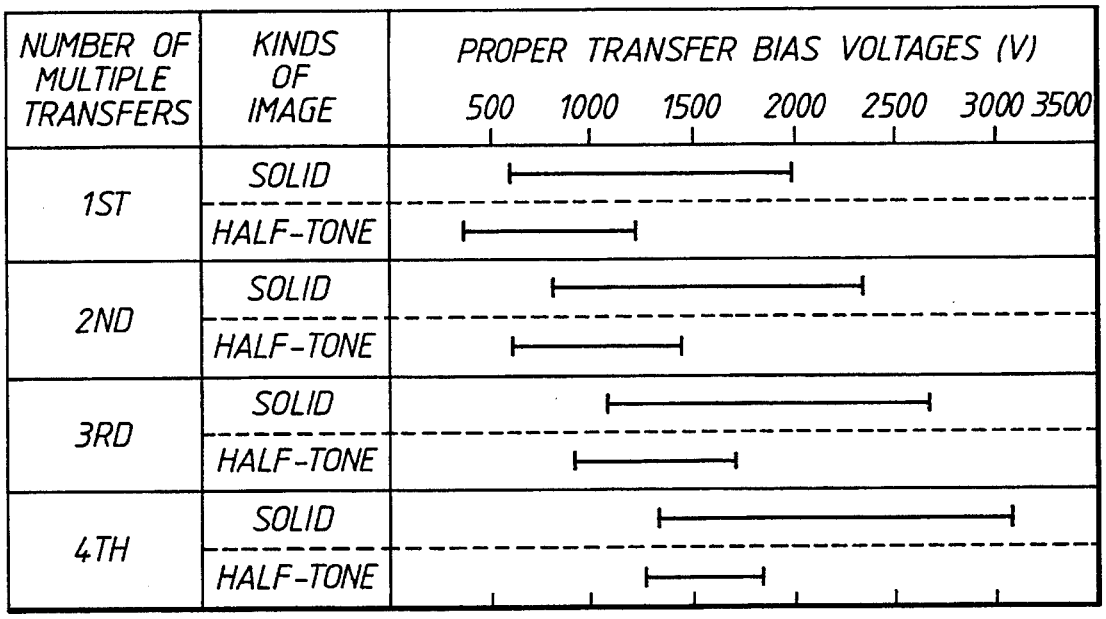
FIG. 11 is a graph showing proper transfer bias voltages in a multi-colored image forming apparatus to which the present invention was not applied, for the purpose of comparison with the graph shown in FIG. 10.

On the other hand, when all of the photosensitive drums and the voltage supply rollers are kept in contact with each other through the conveyor belt, that is, the optimum transfer margin at a separation distance 0 mm is as shown in FIG. 11. From FIGS. 10 and 11, it can be seen that the half-tone image transfer margin will become wide likewise the first embodiment when the transfer electric field is formed by arranging the voltage supply rollers apart from the photosensitive drums as resistance is increased by the conveyor belt.

Figure 12:
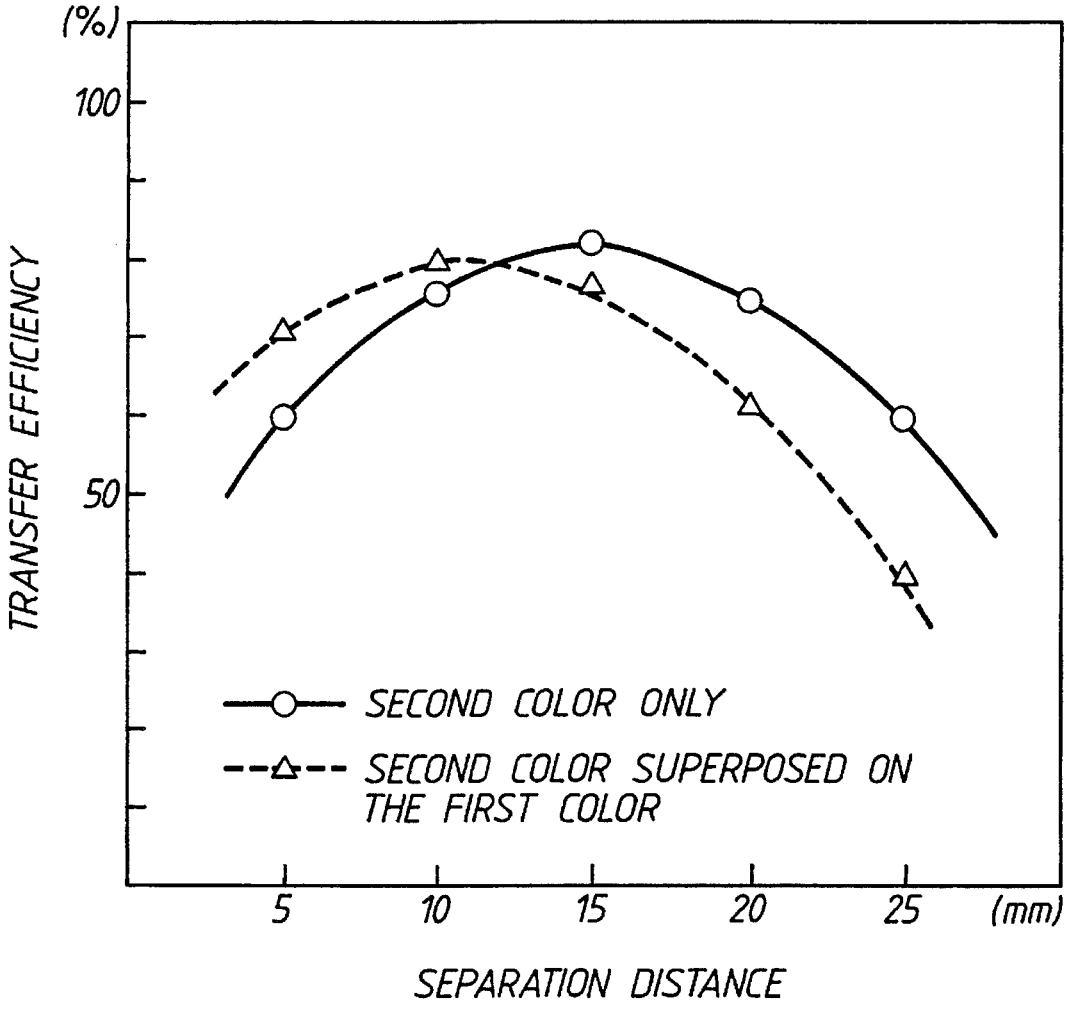
FIG. 12 is a graph showing the relationship of separation distance and transfer efficiency between the photosensitive drums and voltage supply rollers.

From FIG. 10, the optimum transfer voltage was decided at 1,300 V which was an intermediate value of the transfer margin. On the other hand, in the multi-colored image forming apparatus shown in FIG. 9, the separation distance between the voltage supply roller 23*b* and the photosensitive drum 1*b* was set at 10 mm for applying transfer voltage for the second color, 8 mm for the third color and 6 mm for the fourth color. Optimum values of this separation distances are decided according to an experiment to increase transfer efficiency of the electric field at the downstream side in multiple transfers. For instance, the measured result of transfer efficiency of the second color is shown in FIG. 12. In this figure, transfer efficiency of the second color superposed on the first color is compared with that of the second color only; the axis of abscissa shows a separation distance between the photosensitive drum and the voltage supply roller and the axis of ordinates shows transfer efficiency. Based on this result, the optimum distance satisfying transfer efficiency of both cases was decided at 10 mm. Similarly, the optimum separation distance for the third color transfer was decided by evaluating transfer efficiency in transferring and superposing three colors and that in transferring the third color only.

Figure 13:
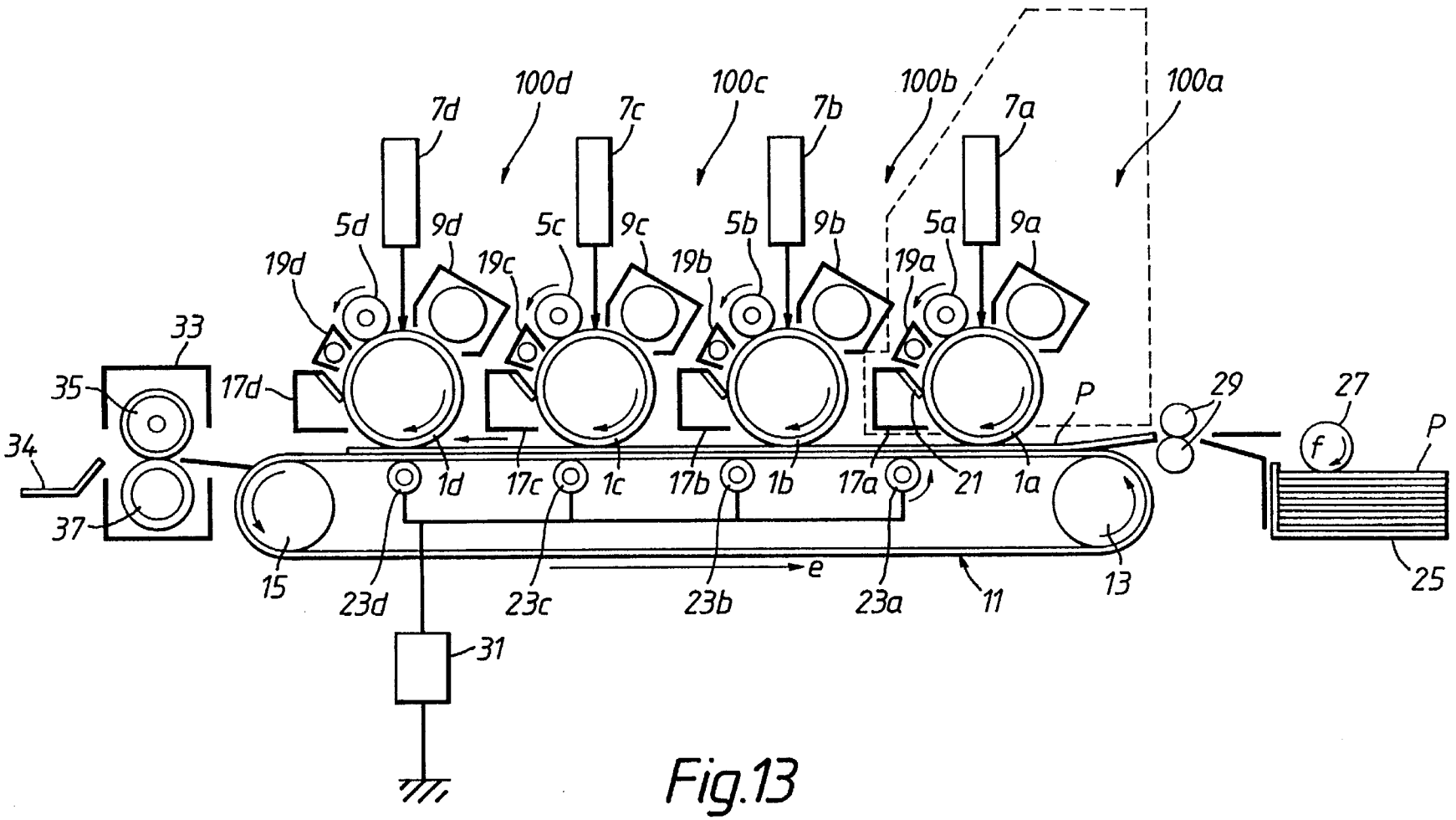
FIG. 13 is a schematic diagram showing a third embodiment of the multi-colored image forming apparatus of the present invention.

A third mebodiment of the multi-colored image forming apparatus of the present invention will be described with reference to FIG. 13. What is different between the first and the third embodiments is the location where the voltage supply rollers were arranged. That is, the voltage supply rollers were arranged so that a separation distance between the voltage supply roller 23*a'* for the first color and the photosensitive drum 1*a* would become 12 mm, a separation distance between the voltage supply roller 23*b'* for the second color and the photosensitive drum 1*b* would become 8 mm and a separation distance between the voltage supply roller 23*c'* for the third color and the photosensitive drum 1*c* would become 4 mm, and a separation distance between the voltage supply roller 23*d'* for the fourth color and the photosensitive drum 1*d* would become 0 mm. In the last case, the photosensitive drum 1*d* and the voltage supply roller 23*d'* were not separated at the most downstream transfer location. However, as the separation distance would become relatively larger at the upstream side than the downstream side in the direction of conveying the paper P, a target transfer electric field is formed at the upstream side in the direction of conveying the paper P and the multiple transfer would be carried out stably.

The separation distance between the voltage supply roller 23*a'* for applying the first color transfer voltage and the photosensitive drum 1*a* was set at 12 mm. This distance is the maximum distance for the voltage supply roller 23*a'* to maintain a force to compress the paper P against the photosensitive drum la without deflecting the convenyor belt 11*a*. If the distance is larger than this value, a space between the photosensitive drum 1*a* and the paper P becomes large due to the deflection of the conveyor belt 11*a* and a poor transfer is caused, lowring transfer efficiency.

Figure 14:
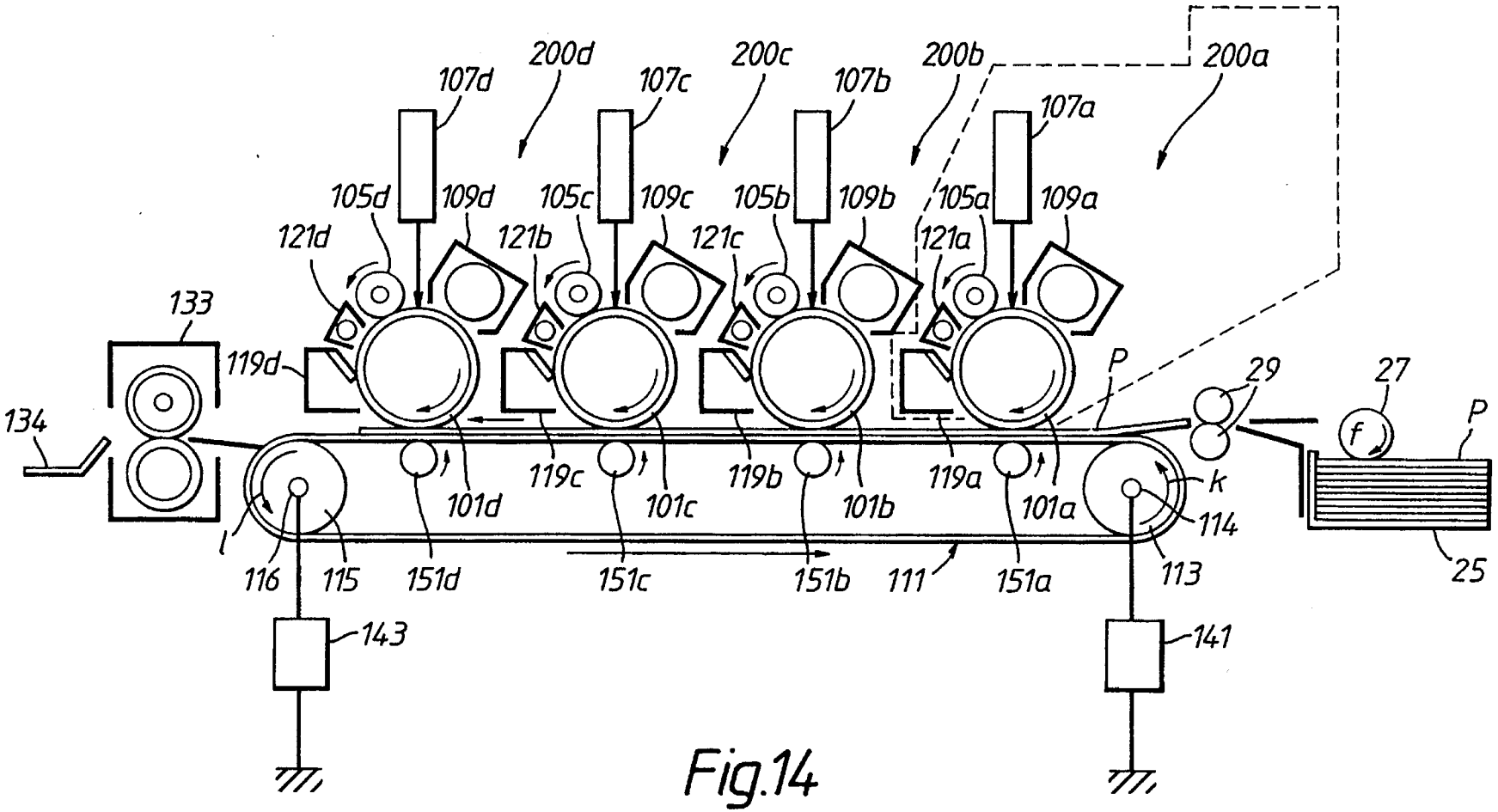
FIG. 14 is a schematic diagram showing a fourth embodiment of the multi-colored image forming apparatus of the present invention.

Next, a fourth embodiment of the multi-colored image forming apparatus of the present invention will be described. FIG. 14 is a schematic sectional view showing the multi-colored image forming apparatus of the fourth embodiment. The multi-colored image forming apparatus shown in FIG. 14 is in the same construction as that shown in FIG. 1 and the process units 200*a*, 200*b*, 200*c* and 200*d* have been provided on the conveyor belt 111 along the conveying direction. The process unit 200*a* has a charging roller 105*a* and an exposure portion 107*a* as latent image forming means and a developing device 109*a* as a developing means around a photosensitive drum 101*a*. Further, a cleaning device 110*a* and a discharge lamp 121*a* are provided at the down stream of the developing device 109*a*. Likewise the process unit 200*a*, charging rollers 105*b*, 105*c* and 105*d* (hereinafter, the charging rollers 105*a*, 105*b*, 105*c* and 105*d* are named generically as a charging roller 105), exposure portions 107*b*, 107*c* and 107*d* (hereinafter, the exposure portions 107*a*, 107*b*, 107*c* and 107*d* are named generically as an exposure portion 107), developing devices 109*b*, 109*c* and 109*d* (hereinafter, and the developing devices 109*a*, 109*b* 109*c* and 109*d* are named generically as a developing device 109) are arranged around photosensitive drums 101*b*, 101*c* and 101*d* (hereinafter, the photosensitive drum 101*a*, 101*b*, 101*c* and 101*d* are named generically as a photosensitive drum 109), respectively. Similarly, cleaning devices 119*b*, 119*c* and 119*d* (hereinafter, the cleaning devices 119*a*, 119*b*, 119*c* and 119*d* are named generically as a cleaning device 119) and discharge lamps 121*b*, 121*c* and 121*d* (hereinafter, the discharge lamps 121*a*, 121*b*, 121*c* and 121*d* are named generically as a discharge lamp 121) are provided at the downstream of the developing devices 109*b*, 109*c* and 109*d*.

The photosensitive drum 101 of the process unit 200 is brought in contact with the surface of the paper P being held on a conveyor belt 111.

The conveyor belt 111 is made of a 140 μm thick polycarbonate in which carbon has been uniformly dispersed. Resistance of the conveyor belt 111 per $cm^2$ in the direction of thickness is $10^8$ $\Omega.cm^2$. This endless type conveyor belt 111 has the width almost equal to the length in the rotating shaft direction of a photosensitive drum 101. This conveyor belt 111 is formed in the endless shape and conductive driving roller 113 and rotative roller 115 are provided at the circular portion of the upstream side and the downstream side of the conveyor belt 111 to support this conveyor belt. The driving roller 113 is connected with a driving source, for example, a motor to be rotate. At the circular portion, the conveyor belt 111 is in contact with the driving roller 113 and the rotative roller 115 along the outer circumferences of the rollers 113 and 115. A distance from the driving roller 113 to the rotative roller 115 is approx. 300 mm. Supportive rollers 151*a* to 151*c* are arranged between the driving roller 113 and rotative roller 115 to support the conveyor belt 111. The supportive rollers 151*a* to 151*c* act to prevent deflection of the conveyor belt 111. Since the the supportive rollers 151*a* to 151*d* also rotate with the rollers 113 and 115, the ability of conveying the paper P by the conveyor belt 111 does not deteriorate. The rollers 113 and 115 are provided rotatably in the directions of arrows k and i, respectively. When the driving roller 113 and the rotative roller 115 rotate, the conveyor belt 111 is moved in the direction of arrow.

The lengths of the driving roller 113 and the rotative roller 115 in the direction of the axis of rotation are almost equal to that of the photosensitive drum 101. Further, metallic shafts 114 and 116 have been provided as the rotating shafts to the rollers 113 and 115 penetrating the rollers paralled with the direction of the rotating shaft of the photosensitive drum.

In the multi-colored image forming apparatus shown in FIG. 14, the image forming process similar to that in the multi-colored image forming apparatus shown in FIG. 1 is executed. That is, a electrostatic latent image is formed on the respective photosensitive drum 101*a* through 101*d* and is developed in respective colors by the developing devices 109*a* through 109*d*. The developed image thus formed is transferred in multiple colors and fixed on the paper P that is conveyed by the conveyor belt 111 by a fixer 133. Thereafter, the paper P is ejected on a receiving tray 134.

The metalic shaft 114 of the driving roller 113 arranged at the upstream side in the paper conveying direction is connected to the power source 141 which, as the first voltage applying means, applies bias voltage to this driving roller 113. Similarly, the metalic shaft 116 of the rotative roller 115 arranged at the downstream side in the paper conveying direction is connected to the power source 143 which, as the second voltage applying means, applies bias voltage to the rotative roller 115. The bias voltage applied to the supply roller 115 here has a larger absolute value than the bias voltage to be applied to the driving roller 113. When bias voltage is applied to the conductive rollers 113 and 115, bias voltage is applied to the conveyor belt 111 and the conveyor belt is thus charged. Therefore, a transfer electric field is formed between the conveyor belt 111 and respective photosensitive drums 101*a* through 101*d*, and the image developed in respective colors are sequentially transferred on the paper P.

In this fourth embodiment, +1000 V DC voltage was applied to the driving roller 113 and +2,000 V DC voltage was applied to the rotative roller 115, and a potential diffence of bias voltages between the driving roller 113 and rotative roller 115 was maintained constantly at 1,000 V.

Using such the multi-colored image forming apparatus, the image forming was conducted under normal temperature and humidity. In the manner similar to the embodiment described above, the range of proper transfer bias voltages to the driving roller 113 for satisfactory transfer of a solid image and a half-tone image was investigated and the almost same result as that shown in FIG. 3 was obtained.

That is, although proper transfer bias voltage of the driving roller 113 shifts slightly in the multiple transfer direction, the range of respective transfer voltages becomes wide. Therefore, it was revealed that stable transfer can be made under a constant transfer bias voltage for multiple transfers.

This is because when bias voltage is supplied to the rollers 113 and 115, the change in a transfer electric field caused by environmental changes, etc. becomes gentle more than that when a transfer is made at a location where respective photosensitive drums 101*a* through 101*d* are in contact with the paper P. Because of this reason, a proper transfer bias voltage range for a half-tone image becomes wide.

Further, as bias voltage is a larger absolute value was being applied to the rotative roller 115 than the driving roller 113, the shifting of proper transfer bias voltage in a higher level in the multiple transfer direction was suppressed to the minimum.

Further, when the image formation was conducted by the multi-colored image forming apparatus shown in FIG. 14 by cahnging environmental conditions of temperature and humidity, a stable transfer could be made under a constant transfer bias voltage. In this fourth embodiment, such high resisting conductive materials as polyethylene terephthatate, polyimide, polytetrafluoroethylene (Teflon) with carbon or other conductive particle dispersed may be used in addition to polycarbonate in which carbon was dispersed. Further, such high molecular films with ion conductive materials mixed or silicon rubber/urethane rubber having relatively low electric resistance may be used. However, any material that is used for the conveyor belt 111 should have resistance per $cm^2$ in the direction of thickness to $10^6$ through $10^{10}$ $\Omega.cm^2$.

A difference between an absolute value of bias voltage applied to the driving roller 113 provided at the upstream side of the conveyor belt 111 and that of bias voltage applied to the rotative roller 115 provided at the downstream side of the conveyor belt 111 may be approx. 1,000 V. Thus, by applying bias voltage from the first and second voltage applying means, it becomes possible to make a size of electric field larger at the downstream side of the conveyor belt 111.

That is, if resistance per $cm^2$ in the direction of thickness of the conveyor belt 111 is $10^6$ through $10^{10}$ $\Omega.cm^2$ and a potential difference between the driving roller 113 at the upstream side and the rotative roller 115 at the downstream side is set at approx. 1,000 V, it is necessary to apply bias voltage above 1,000 V to the driving roller 113 at the upstream side. On the contrary, it is necessary to apply bias voltage below 6,000 V to the rotative roller 115 at the downstream side. If bias voltage applied to the driving roller 113 at the upstream side is less than 1,000 V, it is not possible to form a transfer electric field of sufficient intensity. Further, if bias voltage applied to the rotative roller 115 at the downstream side is above 6,000 V, the conveyor belt 111 may cause dielectric breakdown.

An arrangement of the driving roller and rotative roller on which the conveyor belt 111 is mounted may be changed. That is, the driving roller to which a driving source, for example, a motor is connected may be provided at the downstream side and the rotative roller may be provided at the upstream side. In this case, +1000 V DC voltage is applied to the rotative roller at the upstream side and +2,000 V DC voltage is applied to the driving roller at the downstream side, and a potential diffence of bias voltages between the driving roller and rotative roller is maintained constantly at 1,000 V.

As described above, according to the multi-colored image forming apparatus of the present invention, proper transfer bias voltage range of a half-tone image becomes wide and it is therefore possible to perform a stable image transfer in the multiple image transfer without being affected by environmental changes, etc.

Further, since the electrical transfer field can strengthen at the downstream with the few number of transfer voltages, stable multiple transfer of the developed images can be performed in a small sized image forming apparatus.

What is claimed is:

1. An image forming apparatus comprising:

first image forming means for forming a first image on a first image carrier;

second image forming means for forming a second image on a second image carrier;

conveying means confronting the first and second image carriers for conveying an image receiving medium to the first and second image carriers successively;

first transferring means for transferring the first image from the first image carrier to the image receiving medium, the first transferring means being located at a first distance from a first transfer position of the first image carrier along a conveying direction of the image receiving medium;

second transferring means for transferring the second image from the second image carrier to the image receiving medium, the second transferring means being located at a second distance from a second transfer position of the second image carrier shorter than the first distance along the conveying direction of the image receiving medium; and applying means for applying a common transfer bias voltage to the first and second transferring means to form first and second electric fields at the first and second transfer positions, respectively.

2. An image forming apparatus according to claim 1, wherein the conveying means includes an endless conveyor belt on which the image receiving medium is set, the endless conveyor belt having a resistance of $10^6$ to $10^{10}$ $\Omega.cm^2$ in the direction of thickness per $cm^2$, the first and second electric fields at the first and second transfer positions being formed through parts of the conveyor belt respectively corresponding to the first and second distances.

3. An image forming apparatus according to claim 1, wherein each of the first and second transferring means includes a rotatable transfer roller, the first distance being less than 12 mm.

4. An image forming apparatus according to claim 1, wherein the first and second transferring means are respectively located downstream of the first and second transfer positions.

5. An image forming apparatus according to claim 1, wherein the first and second transferring means are electrically connected in parallel to the applying means.

6. An image forming apparatus including a first image carrier on which a first image is formed, a second image carrier on which a second image is formed, and an image receiving medium conveyor for conveying the medium to the first and second image carriers successively, the apparatus comprising:

first transferring means for transferring the first image from the first image carrier to the image receiving medium, the first transferring means being located at a first distance from a first transfer position of the first image carrier along a conveying direction of the image receiving medium;

second transferring means for transferring the second image from the second image carrier to the image receiving medium, the second transferring means being located at a second distance from a second transfer position of the second image carrier shorter than the first distance along the conveying direction of the image receiving medium; and applying means for applying a common transfer bias voltage to the first and second transferring means to form first and second electric fields at the first and second transfer positions, respectively.

* * * * *